US008356979B2

(12) United States Patent
Haynes

(10) Patent No.: US 8,356,979 B2
(45) Date of Patent: Jan. 22, 2013

(54) FAN BLADE MOUNTING SYSTEM

(75) Inventor: Cecil Fred Haynes, Memphis, TN (US)

(73) Assignee: Hunter Fan Company, Memphis, TN (US)

( * ) Notice: Subject to any disclaimer, the term of this patent is extended or adjusted under 35 U.S.C. 154(b) by 597 days.

(21) Appl. No.: 12/570,149

(22) Filed: Sep. 30, 2009

(65) Prior Publication Data

US 2010/0104442 A1 Apr. 29, 2010

Related U.S. Application Data

(60) Provisional application No. 61/108,992, filed on Oct. 28, 2008.

(51) Int. Cl.
*F04D 29/34* (2006.01)

(52) U.S. Cl. ..... 416/210 R; 416/228; 416/231 B

(58) Field of Classification Search ..... 416/210 R, 416/228, 231 B
See application file for complete search history.

(56) References Cited

U.S. PATENT DOCUMENTS

| | | | |
|---|---|---|---|
| 3,392,848 | A | 7/1968 | McConnell et al. |
| 4,187,056 | A | 2/1980 | Schwin et al. |
| 4,197,054 | A | 4/1980 | Morrill |
| 4,245,960 | A | 1/1981 | Matthews |
| 4,936,751 | A | 6/1990 | Marshall |
| 5,102,302 | A | 4/1992 | Schilling et al. |
| 5,110,261 | A | 5/1992 | Junkin |
| 5,304,037 | A | 4/1994 | Scofield |
| 5,354,176 | A | 10/1994 | Schilling et al. |
| 5,458,464 | A | 10/1995 | Lee |
| 5,464,323 | A | 11/1995 | Scofield |
| 5,927,945 | A | 7/1999 | Chen |
| 5,944,486 | A | 8/1999 | Hodgkins, Jr. |
| 5,944,487 | A | 8/1999 | Pearce |
| 5,951,253 | A | 9/1999 | Gajewski |
| 5,954,449 | A | 9/1999 | Wu |
| 5,980,353 | A | 11/1999 | Wu |
| 6,010,306 | A | 1/2000 | Bucher et al. |
| 6,022,191 | A | 2/2000 | Moore et al. |
| 6,039,540 | A | 3/2000 | Wu |
| 6,149,388 | A | 11/2000 | Liao |
| 6,155,786 | A | 12/2000 | Blateri et al. |
| 6,155,787 | A | 12/2000 | Hodgkins, Jr. |
| 6,171,059 | B1 | 1/2001 | Bucher et al. |
| 6,210,117 | B1 | 4/2001 | Bucher et al. |
| 6,250,885 | B1 | 6/2001 | Gajewski |
| 6,309,183 | B1 | 10/2001 | Bucher et al. |

(Continued)

*Primary Examiner* — Ninh H Nguyen
*Assistant Examiner* — Liam McDowell
(74) *Attorney, Agent, or Firm* — Baker Donelson; Dorian B. Kennedy

(57) ABSTRACT

A ceiling fan (10) has an electric motor (13) which rotatably drives an annular array of blade irons (14) coupled to blades (15). Each blade has a fastener mounting hole (18) and an end notch (19). Each blade iron (14) has a blade mounting portion (23) with a blade fastener (24) configured to pass through the fastener mounting hole, and a releasable spring biased catch (27). The fastener has main post (30) and stops (25) configured to overlay the top surface of the blade once the blade is coupled to the blade iron. The catch has a moveable flat spring (28) straddled by two L-shaped guides (29) having an upright wall portion (31) and a horizontal top portion (32). The horizontal top portion is spaced a select distance from the blade iron top surface (26) through the height of the vertical wall portion so as to catch the blade therebetween. The flat spring has a hand gripping portion (34) extending above the top surface of the blade.

12 Claims, 3 Drawing Sheets

U.S. PATENT DOCUMENTS

| | | | | |
|---|---|---|---|---|
| 6,336,792 | B1 | 1/2002 | Bucher et al. | |
| 6,352,409 | B1 | 3/2002 | Blateri et al. | |
| 6,371,729 | B1 | 4/2002 | Tseng | |
| 6,382,917 | B1 | 5/2002 | Zuege | |
| 6,390,777 | B1 | 5/2002 | Kerr, Jr. | |
| 6,508,629 | B2 | 1/2003 | Kerr, Jr. | |
| 6,585,488 | B1 | 7/2003 | Bucher et al. | |
| 6,644,925 | B1 | 11/2003 | Collmar | |
| 6,666,652 | B2 * | 12/2003 | Bucher et al. | 416/210 R |
| 6,669,446 | B2 | 12/2003 | Hodgkins, Jr. | |
| 6,692,233 | B2 | 2/2004 | Liang | |
| 6,699,014 | B1 | 3/2004 | Lam et al. | |
| 6,758,626 | B1 | 7/2004 | Tseng | |
| 6,802,694 | B2 | 10/2004 | Bucher et al. | |
| 6,857,854 | B2 | 2/2005 | Pearce | |
| 6,863,499 | B2 | 3/2005 | Pearce | |
| 6,902,375 | B2 | 6/2005 | Bird et al. | |
| 6,932,576 | B2 | 8/2005 | Bird | |
| 6,935,842 | B2 * | 8/2005 | Tai | 416/210 R |
| 7,008,192 | B2 | 3/2006 | Hidalgo | |
| RE39,448 | E | 12/2006 | Wu | |
| 7,281,899 | B1 | 10/2007 | Bucher et al. | |
| 7,527,478 | B2 | 5/2009 | Pearce | |
| 2004/0013527 | A1 | 1/2004 | Pearce | |

* cited by examiner

FAN BLADE MOUNTING SYSTEM

REFERENCE TO RELATED APPLICATION

Applicant claims the benefit of U.S. Provisional Patent Application Ser. No. 61/108,992 filed Oct. 28, 2008.

TECHNICAL FIELD

This invention relates to ceiling fan blades and blade irons, and specifically to systems for quickly connecting blades to blade irons.

BACKGROUND OF THE INVENTION

Electrically powered ceiling fans typically have a motor mounted within a stationary housing that is suspended from a ceiling. In operation, the motor rotates an annular array of individual extensions in the form of blade irons. Each blade iron is associated with a blade mounted thereto.

Ceiling fans are usually sold at retail with their blades packed separately from the blade irons for compactness. In mounting a ceiling fan, the housing is normally mounted in suspension from the ceiling through a downrod and then the blades are mounted to the blade irons and the blade irons are mounted to the motor.

The blades of ceiling fans are usually coupled to the blade irons by passing mounting screws through holes in the blade and into threaded holes in the blade iron. This task however can be difficult or tedious when the electric motor is already suspended from the ceiling. The difficulty is attributed to the fact that the mounting screws are usually passed from the top of the blade to hide the screw heads from view. The installer must align the holes in the blade with the holes in the blade iron while simultaneously passing the screws through the holes. The installer typically does this from a position below the ceiling fan, thereby limiting the installer's ability to view the mounting holes and thus aligning the mounting holes and drivably rotate the screws.

Accordingly, it is seen that a need remains for a blade that can be quickly and easily mounted to a blade iron. It is to the provision of such therefore that the present invention is primarily directed.

SUMMARY OF THE INVENTION

Figure 1:
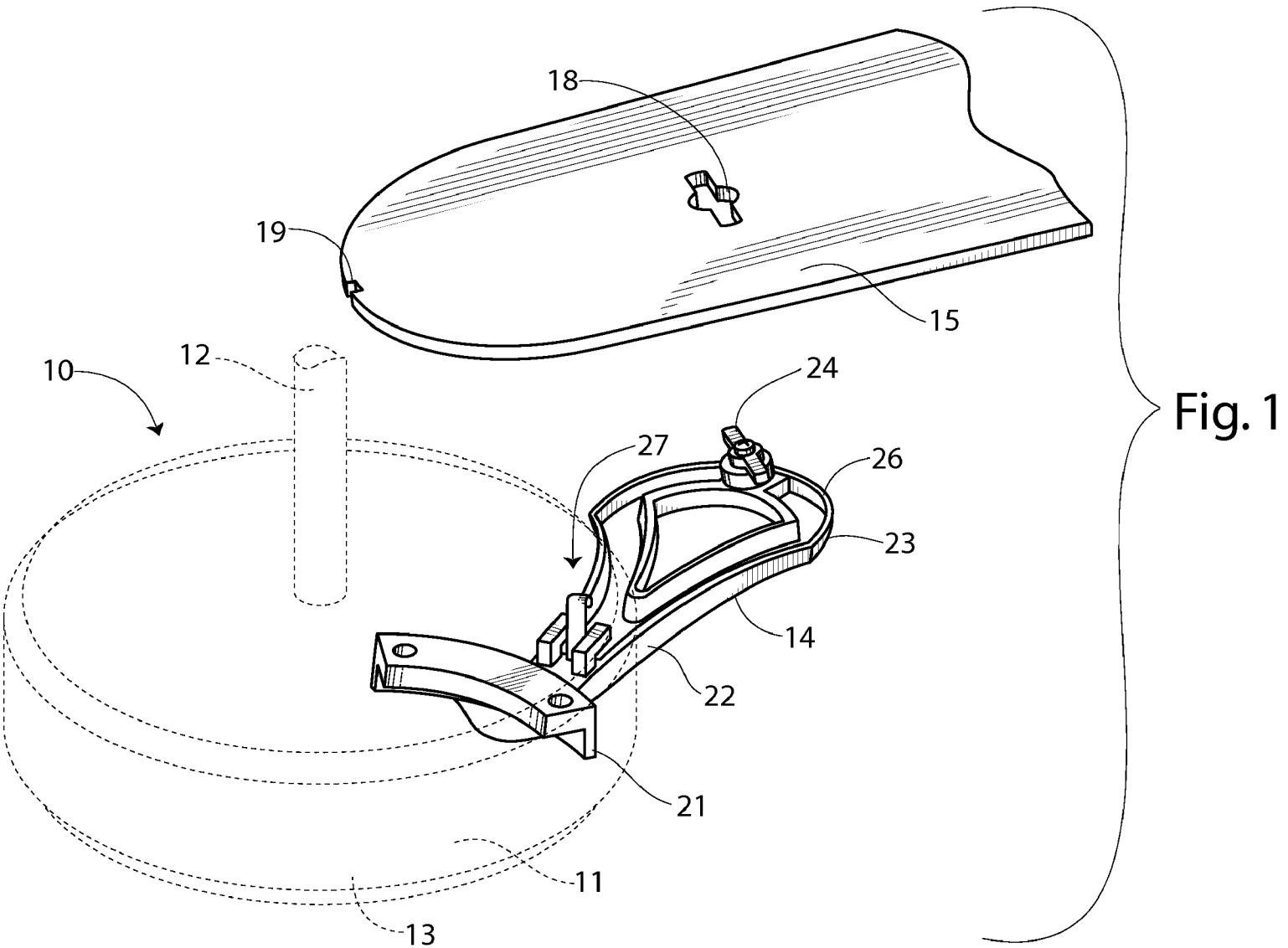
FIGS. 1-3 are a series of perspective views of the ceiling fan blade and blade iron embodying principles of the invention in a preferred form.

In a preferred form of the invention a ceiling fan comprises an electric motor, an annular array of blade irons mounted to the motor, and ceiling fan blade associated with each blade iron of the annular array of blade irons. Each blade has a top surface, a pivot mounting hole therethrough and a notch. Each blade iron has a releasable catch and a pivot pin configured to be received within the blade pivot mounting hole to allow pivotal movement of the blade relative to the blade iron. The pivot pin includes a member adapted to overlay the blade top surface to restrict the blade from moving away from the blade iron. The catch is adapted for movement between an unlocked position positioned externally of the blade notch and a locked position positioned within the blade notch. With the catch in its locked position the catch prevents the pivotal movement of the blade about the pivot pin relative to the blade iron.

DETAILED DESCRIPTION

With reference next to the drawings, there is shown a ceiling fan 10 having a motor housing 11 suspended from an unshown ceiling by a downrod 12. An electric motor 13 is mounted within the housing 11 and connected to a source of electric power by wires that extend through the downrod 12. The motor rotatably drives an annular array of blade irons 14, only one being shown for clarity, each having a blade 15 mounted thereto.

Each blade has a key-hole type, fastener mounting hole 18 extending therethrough, the fastener mounting hole may also be considered a pivot mounting hole. The blade also has an end notch 19 extending inwardly from the end of the blade closest or adjacent the motor 13.

Each blade iron 14 has a motor mounting flange 21 configured to be coupled with the electric motor 13 for rotation, a neck 22, and a blade mounting portion 23. The blade mounting portion 23 has a top surface 26 facing the ceiling, a blade fastener or pivot pin 24 configured to pass through the fastener mounting hole 18, and a releasable spring biased tang, clip or catch 27 coupled to and extending from the blade iron top surface 26. The fastener 24 has main post 30 and wing members or stops 25 configured and positioned so as to overlay the top surface of the blade once the blade is coupled to the blade iron.

The catch 27 has a generally vertical, moveable flat spring 28 straddled by two L-shaped guides 29 having an upright wall portion 31 and a horizontal flange or top portion 32. The horizontal top portion 32 is spaced a select distance from the blade iron top surface 26 through the height of the vertical wall portion 31 so as to catch the blade 15 therebetween, and catch the blade within an undercut channel 33 defined by the guides. The flat spring 28 has a hand gripping portion 34 extending above the top surface of the blade 15. The flat spring 28 is configured to removably nest within blade end notch 19. It should be noted that the blade iron fastener 24 and blade fastener mounting hole 18 are oriented so that they mate to allow the passage of the fastener through the mounting hole only when the blade is pivotally offset from a radially aligned position, or unlocked position, wherein the blade is positioned while in its operational mode or locked position, i.e., the blade is in a locked position when in is aligned along a radial R extending from the electric motor and in an unlocked position when the blade is not aligned with the radial.

Figure 2:
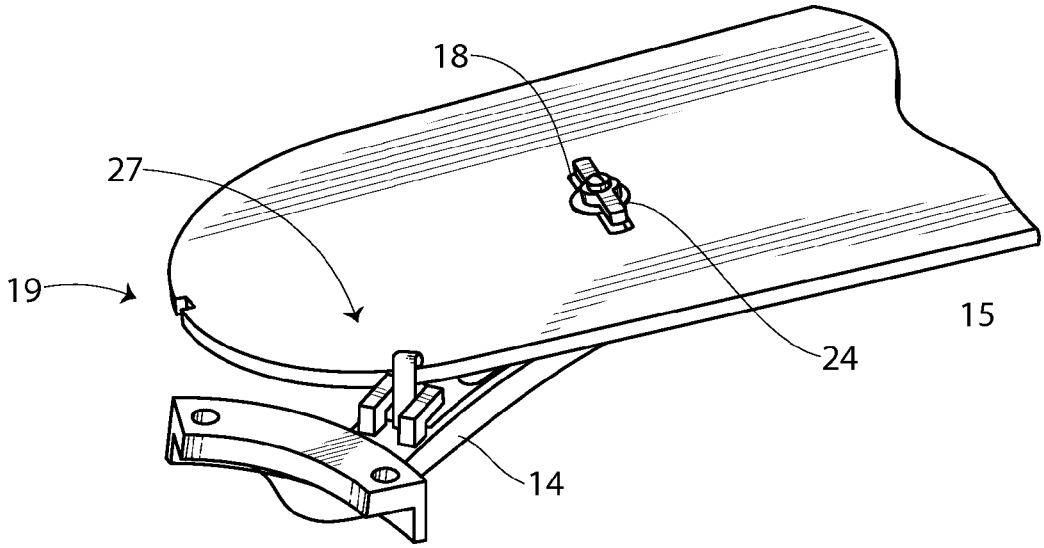
Figure 3:
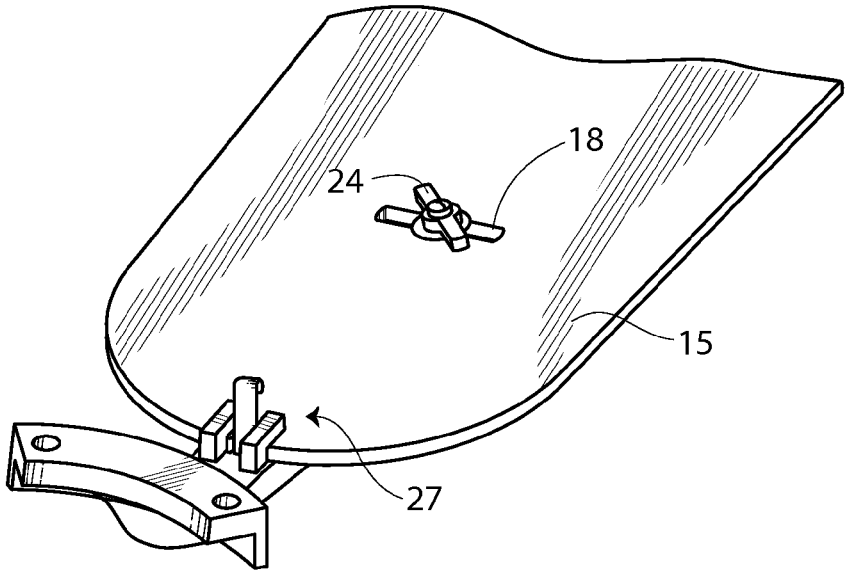
Figure 4:
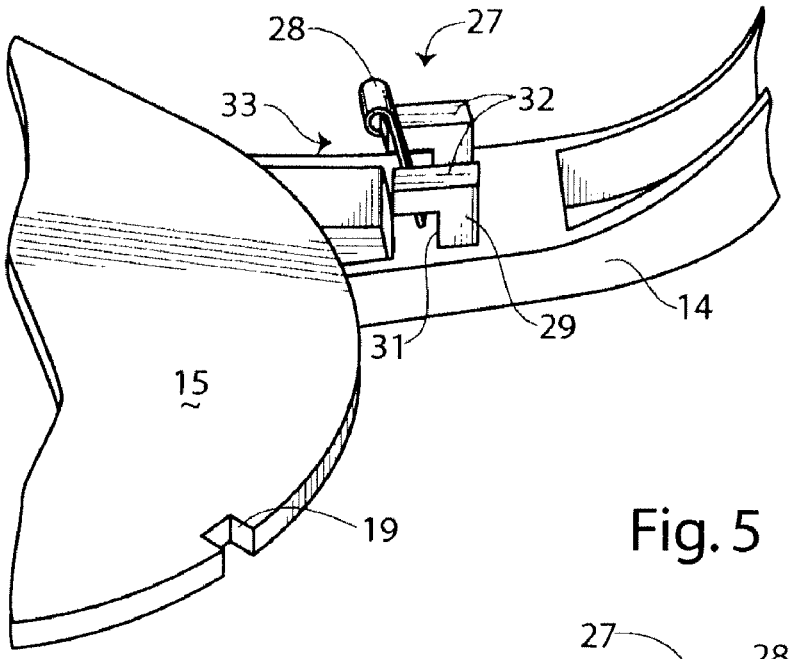
FIG. 4 is an enlarged perspective view of a portion of the fan blade iron and blade of FIG. 1.
Figure 5:
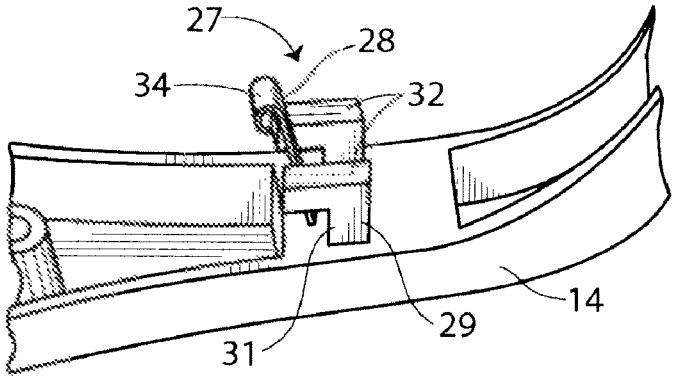
FIG. 5 is an enlarged perspective view of a portion of the fan blade iron and blade of FIG. 1.
Figure 6:
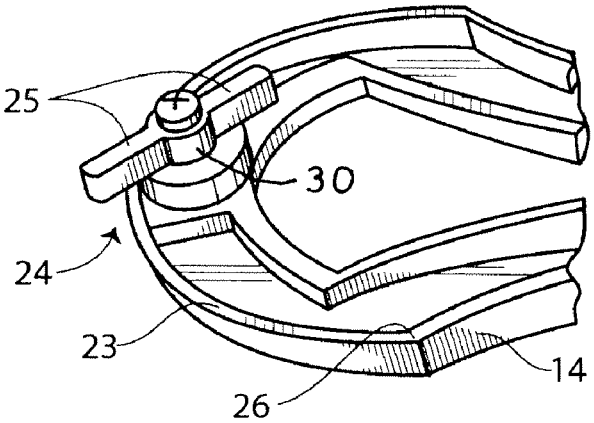
FIG. 6 is an enlarged perspective view of a portion of the fan blade iron and blade of FIG. 1.

In use, the downrod 12 is coupled to the ceiling with the motor housing 11 coupled to the opposite end of the downrod with the blade irons 14 already mounted to the motor 13. With the blade in angularly offset from its operational mode, i.e., radially offset, the blade is lowered so that the blade iron fastener 24 passes through the blade fastener mounting hole 18, as shown in FIGS. 1 and 2. The blade is then pivoted about the blade iron fastener 24 with the blade passing below the fastener wing members 25 and below the guide top portions 32 until the catch flat spring 28 moves from an unlocked position to a locked position wherein the catch is positioned within or nests within the blade notch 19, as shown in a locked position in FIG. 3. The L-shaped guide top portions 32 prevent the end of the blades from tilting upwardly thereby disconnecting the blade from the blade iron while the flat spring 28 prevents further pivotal movement of the blade relative to the blade iron.

The blade 15 may likewise be dismounted from the blade iron 14 by simply moving the flat spring 28 towards the motor thereby removing it from its nested position within the notch. Now, the blade 15 may be pivoted to its offset or unlocked position wherein the blade iron fastener may pass back through the fastener mounting hole 18.

It should be understood that the relative positioning of the catch flat spring and notch may be reversed.

It thus is seen that a quick connect ceiling fan blade is now provided which enables the blade to be mounted and dismounted easily, quickly and in a reliable and secure manner. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. A ceiling fan comprising:

an electric motor;

an annular array of blade irons counted to said motor, and a ceiling fan blade associated with each said blade iron of said annular array of blade irons, each said blade having a top surface, a peripheral edge, a pivot mounting hole therethrough and a notch extending inwardly from said peripheral edge, each said blade iron having a releasable catch and a pivot pin configured to be received within said blade pivot mounting hole to allow pivotal movement of said blade relative to said blade iron, said pivot pin includes a member adapted to overlay said blade top surface to restrict said blade from moving away from said blade iron, said catch being adapted for movement between an unlocked position positioned externally of said blade notch and a locked position positioned within said blade notch, and with said catch in its locked position said catch prevents the pivotal movement of said blade about said pivot pin relative to said blade iron.

2. The ceiling fan of claim 1 wherein said catch is spring biased.

3. The ceiling fan of claim 2 wherein said pivot pin is a post and wherein said post member is a pair of wings extending from said post, and wherein said blade pivot hole is configured to allow the passage of said post and pair of wings with the blade in said unlocked position and configured so that said wings overlie said blade top surface with said blade in said locked position.

4. The ceiling fan of claim 3 wherein said catch is spring biased.

5. The ceiling fan of claim 1 wherein each said blade iron further includes a guide positioned to be directly adjacent an end of said blade proximal said motor and configured to overhang said blade so that a portion of said guide abuts said blade top surface.

6. The ceiling fan of claim 1 wherein said catch includes a gripping portion extending above said blade top surface.

7. A ceiling fan comprising:

an electric motor;

an annular array of blade irons mounted to said motor, each said blade iron having pivot pin with a main post and at least one stop extending from said main post, each said blade iron also having a releasable catch, and a ceiling fan blade associated with each said blade iron of said annular array of blade irons, each said blade having at least one pivot pin mounting hole configured to allow the passage of said pivot pin stop and at least a portion of said main post with said blade in an unlocked position and being configured to prevent the passage of said pivot pin stop with said blade in a locked position longitudinally aligned along a radial extending from said electric motor, each said blade also having a peripheral edge with an inwardly extending notch configured to receive said catch with said blade in said locked position.

8. The ceiling fan of claim 7 wherein said catch is spring biased.

9. The ceiling fan of claim 8 wherein said pivot pin is a post and wherein said post member is a pair of wings extending from said post, and wherein said blade pivot hole is configured to allow the passage of said post and pair of wings with the blade in said unlocked position and configures so that said wings overlie said blade top surface with said blade in said locked position.

10. The ceiling fan of claim 9 wherein said catch is spring biased.

11. The ceiling fan of claim 7 wherein each said blade iron further includes a guide positioned to be directly adjacent an end of said blade proximal said motor and configured to overhang said blade so that a portion of said guide abuts said blade top surface.

12. The ceiling fan of claim 7 wherein said catch includes a gripping portion extending above said blade top surface.

* * * * *